US009759230B2

(12) United States Patent
Heikurinen et al.

(10) Patent No.: US 9,759,230 B2
(45) Date of Patent: Sep. 12, 2017

(54) MULTISTAGE AXIAL FLOW COMPRESSOR

(71) Applicant: Pratt & Whitney Canada Corp., Longueuil (CA)

(72) Inventors: Kari Heikurinen, Oakville (CA); Ronald Dutton, Guelph (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 862 days.

(21) Appl. No.: 14/163,588

(22) Filed: Jan. 24, 2014

(65) Prior Publication Data

US 2015/0211546 A1 Jul. 30, 2015

(51) Int. Cl.

| | |
|---|---|
| ***F01D 1/00*** | (2006.01) |
| ***F04D 29/54*** | (2006.01) |
| ***F04D 19/02*** | (2006.01) |
| ***F04D 29/68*** | (2006.01) |
| ***F01D 5/14*** | (2006.01) |

(52) U.S. Cl.

CPC ..... *F04D 29/541* (2013.01); *F01D 5/143* (2013.01); *F01D 5/145* (2013.01); *F04D 19/028* (2013.01); *F04D 29/547* (2013.01); *F04D 29/681* (2013.01); *F05D 2270/17* (2013.01)

(58) Field of Classification Search

CPC .... F04D 29/541; F04D 29/547; F04D 29/681; F04D 19/028; F01D 5/143; F01D 5/145; F05D 2270/17; F05D 2270/101; F05D 2270/102; F05B 2270/1081; F05B 2270/10812

USPC ..... 415/1, 207, 182.1, 914, 222, 209.1, 415/209.4, 210.1, 199.5

See application file for complete search history.

(56) References Cited

U.S. PATENT DOCUMENTS

| | | | | |
|---|---|---|---|---|
| 2,846,137 | A | 8/1958 | Smith | |
| 4,460,309 | A | 7/1984 | Walsh | |
| 4,606,699 | A | 8/1986 | Hemsworth | |
| 4,645,417 | A * | 2/1987 | Wisler | F01D 11/08 415/173.1 |
| 5,397,215 | A | 3/1995 | Spear et al. | |
| 6,017,186 | A | 1/2000 | Hoeger et al. | |
| 6,312,221 | B1 | 11/2001 | Yetka et al. | |
| 7,011,495 | B2 | 3/2006 | Guemmer | |

(Continued)

FOREIGN PATENT DOCUMENTS

| | | |
|---|---|---|
| JP | 6257596 | 9/1994 |

*Primary Examiner* — Jason Shanske
*Assistant Examiner* — Kelsey Stanek
(74) *Attorney, Agent, or Firm* — Norton Rose Fulbright Canada

(57) ABSTRACT

A multi-stage axial compressor with an inner wall including a step portion for each of the compressor stages. Each step portion is defined along a respective stage. Each step portion may extend over at least a majority of an axial length of the stage. Each step portion may optionally include a point aligned with a maximum thickness of the airfoil portions of the rotor blades and a point aligned with a maximum thickness of the stator vanes. Adjacent step portions are connected by a transition portion converging toward a central axis of the compressor from the upstream step to the downstream step. Each transition portion has a steeper slope than that of the adjacent step portions. A method of directing flow through a multi-stage axial flow compressor is also discussed.

21 Claims, 5 Drawing Sheets

(56) References Cited

U.S. PATENT DOCUMENTS

| | | | | |
|---|---|---|---|---|
| 8,562,288 | B2 * | 10/2013 | Guemmer | F01D 9/02<br>415/148 |
| 2004/0013520 | A1 | 1/2004 | Guemmer | |
| 2010/0172747 | A1 | 7/2010 | Clark et al. | |
| 2011/0299979 | A1 | 12/2011 | Montgomery | |

* cited by examiner

MULTISTAGE AXIAL FLOW COMPRESSOR

TECHNICAL FIELD

The application relates generally to axial flow compressors and, more particularly, to multistage axial flow compressors.

BACKGROUND OF THE ART

Some gas turbine engines include an axial compressor which acts as a pressure producing machine. Axial compressors generally include a series of stator and rotor blades. Gas is progressively compressed by each stator/rotor compression stage where the rotor blades exert a torque on the fluid. If the static pressure in the axial compressor rises too quickly, flow separation could occur, which in turn could lead to a lower efficiency of the axial compressor.

SUMMARY

In one aspect, there is provided a multi-stage axial compressor comprising: a flow path having a plurality of compressor stages each including a rotor and stator in series, the flow path defined between annular inner and outer walls generally converging from an upstream inlet end to a downstream outlet end of the compressor, the inner and outer walls having a smaller radius at the outlet end than at the inlet end; wherein the inner wall is stepped from the inlet end to the outlet end to define a step portion for each of the stages, each step portion extending across at least a majority of an axial length of the stage, and the inner wall has a transition portion between adjacent step portions which has a steeper axial slope than that of the adjacent step portions, each transition portion having a smaller radius at a downstream one of the adjacent step portions than at an upstream one of the adjacent step portions.

In another aspect, there is provided a multi-stage axial compressor comprising: a flow path having a plurality of compressor stages each including a rotor and a stator in series, the flow path defined between annular inner and outer walls generally converging from an upstream inlet end to a downstream outlet end of the compressor, the inner and outer walls having a smaller radius at the outlet end than at the inlet end; wherein the inner wall is stepped from the inlet end to the outlet end to define a step portion for each of the stages, each step portion including a point on the inner wall radially aligned with a maximum thickness of an airfoil portion of a blade of the rotor of the stage and a point on the inner wall radially aligned with a maximum thickness of an airfoil portion of a vane of the stator of the stage, and the inner wall has a transition portion connecting each adjacent ones of the step portions, each transition portion converging radially inwardly from an upstream one of the adjacent step portions to a downstream one of the adjacent step portions, each transition portion having a steeper slope than that of the adjacent step portions.

In a further aspect, there is provided a method of directing flow through an axial flow compressor having multiple stages, the method comprising: providing a plurality of successive compressor stages each including a stator and a rotor extending across a flow path; for each of the compressor stages, directing flow along a radially inner wall defining the flow path through a portion of the flow path including at least a majority of an axial length of the stage in a first direction having a first slope with respect to an axial direction of the compressor; and between adjacent ones of the stages, directing flow along the radially inner wall in a second direction angled toward a central axis of the compressor with a second slope greater than each first slope.

DESCRIPTION OF THE DRAWINGS

Reference is now made to the accompanying figures in which.

DETAILED DESCRIPTION

Figure 1:
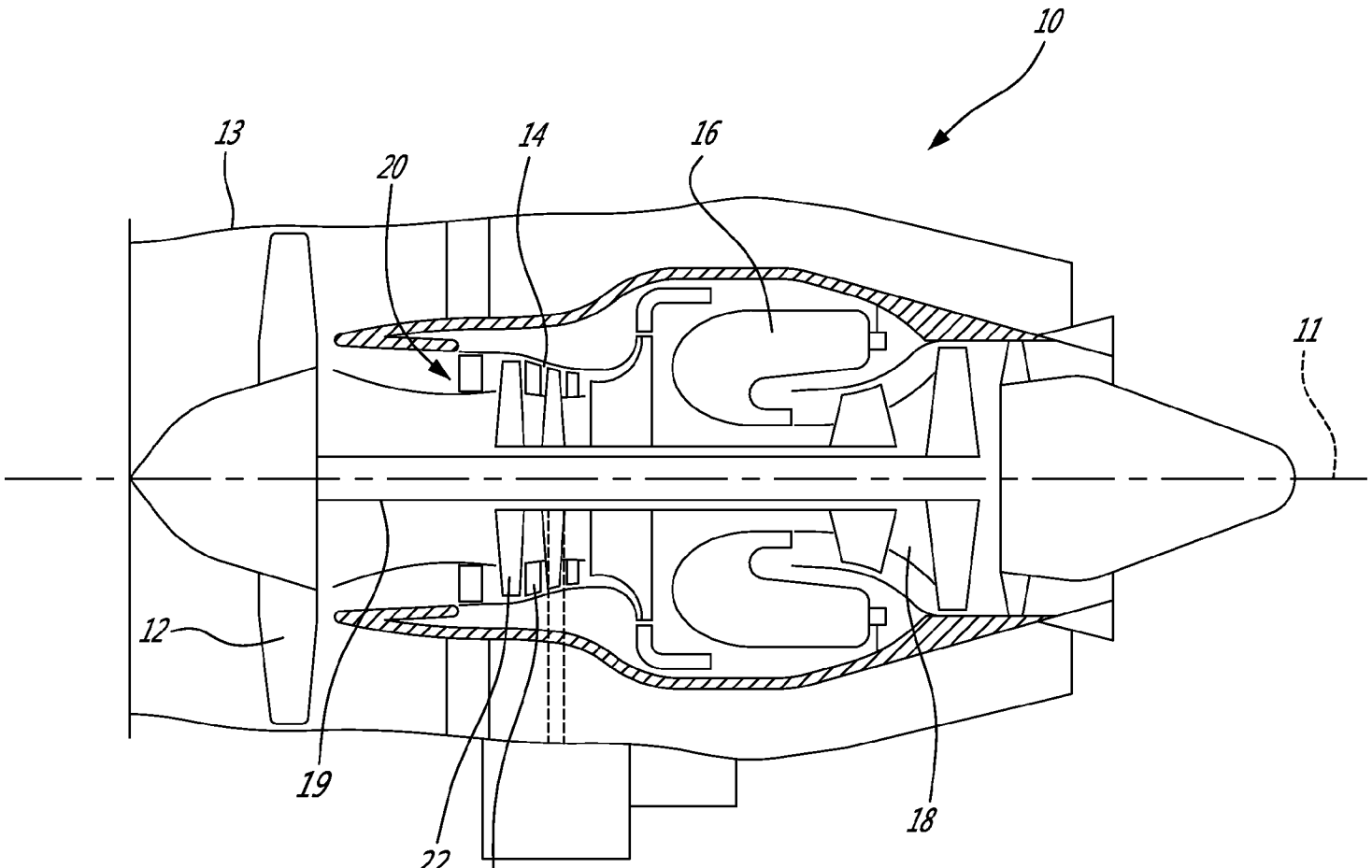
FIG. 1 is a schematic cross-sectional view of a gas turbine engine.

FIG. 1 illustrates a gas turbine engine 10 of a type preferably provided for use in subsonic flight, generally comprising in serial flow communication along a central axis 11, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The above components of the engine 10 are contained in an engine case 13.

Figure 2:
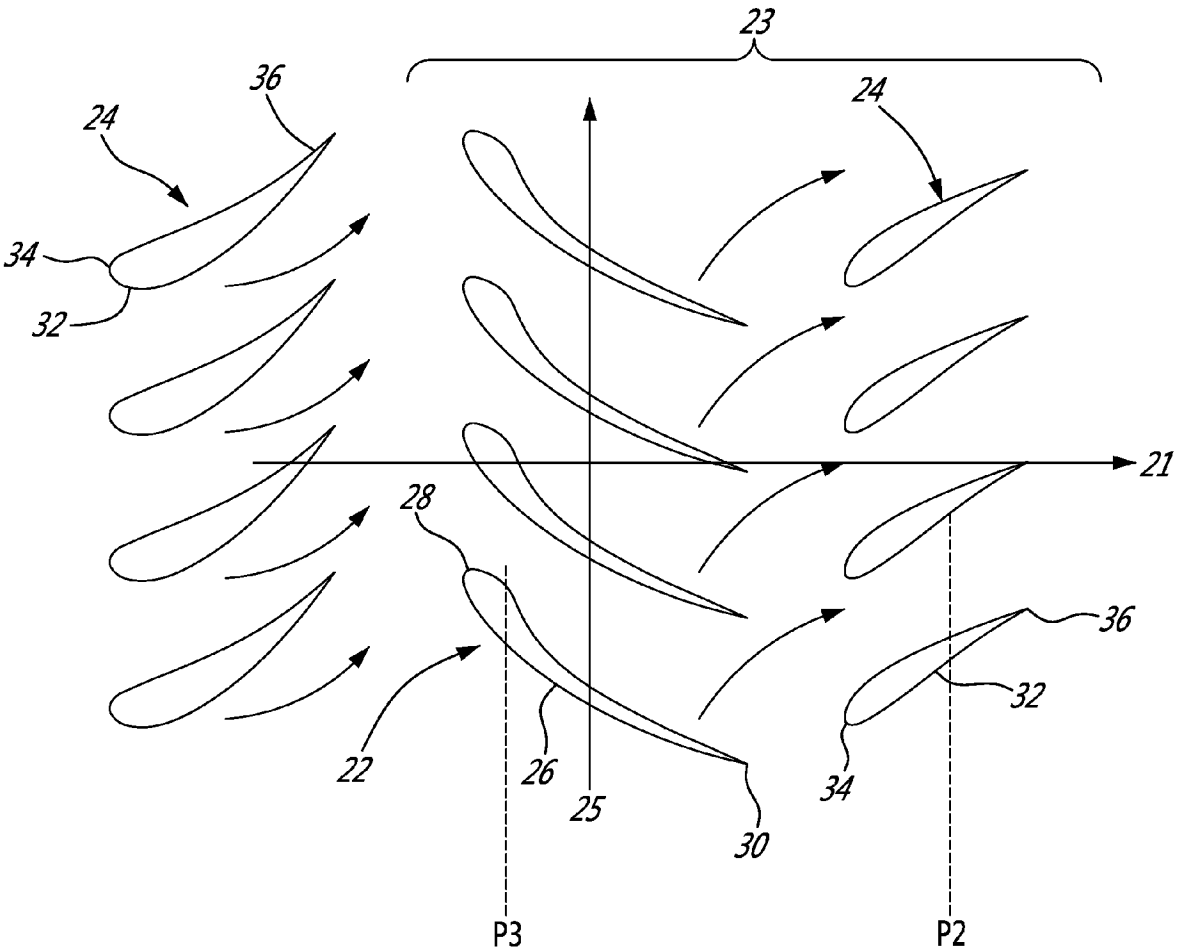
FIG. 2 is a schematic partial top cross-sectional view of stator vanes and rotor blades of a multi-stage axial flow compressor in accordance with a particular embodiment, which may be used in a gas turbine engine such as shown in FIG. 1.
Figure 3:
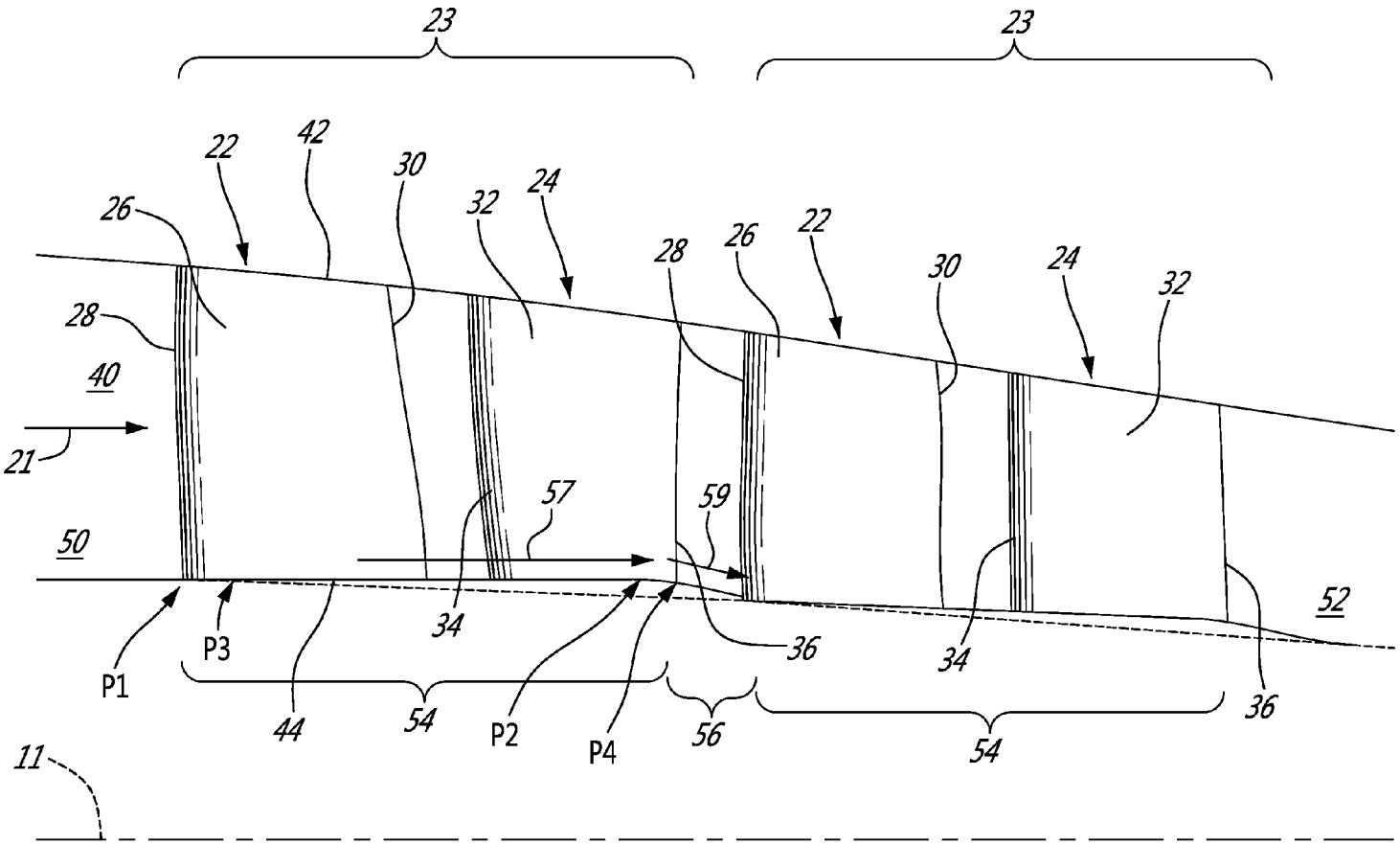
FIG. 3 is a schematic cross-sectional view of a portion of the multi-stage axial flow compressor of FIG. 2.

Referring to FIGS. 2 and 3, the compressor section 14 includes a multi-stage axial flow compressor 20 having a plurality of pairs of rotors 22 and stators 24. Each pair of rotor 22 and stator 24 defines a compression stage 23 of the multi-stage axial flow compressor 20. FIG. 2 shows only one stage 23 and a half of the multi-stage axial flow compressor 20 and FIG. 3 two stages 23 of multiple stages of the axial flow compressor 20. The multi-stage axial flow compressor 20 may comprise any suitable number of stages 23.

Each of the rotors 22 comprises an annular body (not shown) adapted to be mounted on a shaft 19 (shown in FIG. 1) for rotation therewith (a direction of rotation 25 being shown in FIG. 2). The shaft 19 is disposed along the central axis 11 of the engine 10. An array of circumferentially spaced-apart blades 26 extend radially outwardly from the annular body. Each blade 26 has an airfoil portion (best shown in FIG. 2). The airfoil portion has a leading edge 28 and a trailing edge 30 downstream of the leading edge 28 (direction of flow illustrated by arrow 21).

Each of the stators 24 comprises an array of circumferentially spaced-apart extending radially outwardly vanes 32. The vanes 32 are fixed relative to the engine case 13. Each vane 32 has an airfoil portion (best shown in FIG. 2). The airfoil portion has a leading edge 34 and a trailing edge 36 downstream of the leading edge 34. In a particular embodiment, the airfoil portions of the vanes 32 are different from those of the blades 26. FIG. 3 shows only one example of airfoil portions for the blades 26 and vanes 32.

Referring more specifically to FIG. 3, the rotors 22 and stators 24 extend radially or generally radially across the generally radially descending annular flow path 40. The flow path 40 is defined and enclosed by an annular outer wall or shroud 42 and an annular inner wall or shroud 44 of the engine 10 which extend concentrically with the central axis 11 of the engine 10. The inner and outer walls 42, 44 both have a smaller radius at a downstream outlet end 52 of the compressor 20 than at an upstream inlet end 50 of the compressor 20, and the flow path 40 is generally converging from the inlet end 50 to the outlet end 52. In the embodiment shown, the outer wall 42 has a smooth negative slope from the inlet end 50 to the outlet end 52. In the embodiment shown, the outer wall 42 is thus converging radially inwardly from the inlet end 50 to the outlet end 52 relative to the central axis 11. The slope of the outer wall 42 could be constant or variable.

The inner wall 44 is axisymmetrically contoured, that is, radially inwardly stepped from the inlet end 50 to the outlet end 52 relative to the central axis 11. In the embodiment shown, the overall slope of the inner wall 44 is less than that of the outer wall 42 to ensure the radial convergence of the flow path 40 toward the outlet end 52.

The inner wall 44 comprises a plurality of step portions 54 interconnected by transition portions 56. Each step portion 54 of the inner wall 44 includes one of the rotors 22 and the adjacent stator 24 downstream thereof with respect to the flow direction 21, so that each step portion 54 of the inner wall 44 is defined along a respective compression stage 23. On each step portion 54, a slope of the inner wall 44 is generally constant and of small value, so that the step portion 54 extends in a generally axial direction. The step portion 54 may have some curvature and some slope. In a particular embodiment, the step portion is slightly sloped with respect to the axial direction such that its upstream end is located radially outwardly of its downstream end. In another embodiment, each step portion may be slightly sloped with respect to the axial direction such that its upstream end is located radially inwardly of its downstream end. The step portion 54 may also extend substantially or completely parallel to the central axis 11. In a particular embodiment, the slope of the step portion 54 combined with the generally converging outer wall 42 results in a contraction of the flow area and as a result in an acceleration of the flow. The slope is designed so that there is enough acceleration of the flow at the inner wall 44 to prevent flow separation.

Each transition portion 56 has a steeper slope than the adjacent step portions 54, so as to define effectively the stepped characteristic of the inner wall 44. Each transition portion 56 is converging toward the central axis 11, i.e. it has a smaller radius at its downstream end (at the downstream step portion) than at its upstream end (at the upstream step portion). In a particular embodiment, the transition portion 56 is aerodynamically designed so as to reduce an adverse static pressure gradient and thus minimize flow separation. The transition portion 56 is shaped as a smooth curve to accomplish the above. The transition portion 56 could have a constant slope or a variable slope. In some cases, the transition portion 56 is designed to completely prevent flow separation.

In the embodiment shown in the Figures, the step portion 54 extends between the leading edge 28 of one rotor blade 26, as indicated by point P1 in FIG. 3, to a point slightly upstream of the trailing edge 36 of the next stator vane 32 along the flow direction 21, as indicated by point P2. The location P1 is defined on the inner wall 44 at the intersection of the leading edge 28 of the rotors blade 26 with the inner wall 44, for example at the intersection between the airfoil portion of the blade 26 and the blade platform from which the airfoil portion extends. The location P2 is defined on the inner wall 44 upstream of the trailing edge of the adjacent stator vane 32 adjacent the inner wall 44 and downstream of a maximum thickness of the stator vanes 32 (see FIG. 2). The transition portion 56 extends between and connects to the two adjacent step portions 54. It is contemplated however that the step portion 54 and the transition portion 56 could have other dimensions; in a particular embodiment, the step portion 54 extends over at least a majority of an axial length of the stage (the stage defined as extending from the leading edge 28 of the rotor blades 26 of the stage to the trailing edge 36 of the stator vanes 32 of the stage). For example, the step portion 54 may start at any point between the leading 28 and a point P3 (best shown in FIG. 2) radially aligned with the maximum thickness of the airfoil portion of the rotor blades 26. The step portion 54 may also or alternately end at the intersection of the trailing edge 36 of the stator vanes 32 with the inner wall 44 (illustrated by point P4 in FIG. 3).

In use and with reference to FIG. 3, the flow is directed through the compressor along the inner wall 44 in accordance with the following. For each of the stages, the flow is directed along the inner wall 44 of the step portion 54 in a respective first direction 57 having a respective first slope with respect to the axial direction. As mentioned above, in a particular embodiment each of the step portions 54 spans a portion of the flow path including at least a majority of axial lengths of the rotor and stator of the stage. The first direction 57 being defined by the step portion 54, the first slope corresponds to the slope of the step portion 54, which may be zero if the step portion extends parallel to the central axis 11. Between adjacent ones of the stages, in the transition portions 56, the flow is directed along the inner wall 44 in a second direction 59 angled toward the central axis of the compressor with a second slope greater than each first slope. The second direction 59 being defined by the transition portion 56, the second slope corresponds to the slope of the transition portion 56, which is greater than the slope of the step portion 54.

In a particular embodiment, directing the flow in the second direction, along the transition portion 56, includes accelerating the flow and/or reducing an adverse static pressure gradient between the stages. As mentioned above, in a particular embodiment the flow is directed such as to limit flow separation with respect to the inner wall 44.

In a particular embodiment, the slope of the step portion 54 combined with the generally converging outer wall 42 results in a contraction of the flow area and as a result in an acceleration of the flow. This flow area contraction combined with the higher slope of the transition portion 56 helps improve the performance of the stator vanes 32 at the inner wall 44 by helping reducing the adverse static pressure gradient and reducing flow separation. The reduced flow separation on the stator 24 then helps to improve the flow incidence onto the downstream adjacent rotor 22 which then results in improved rotor performance.

Figure 4:
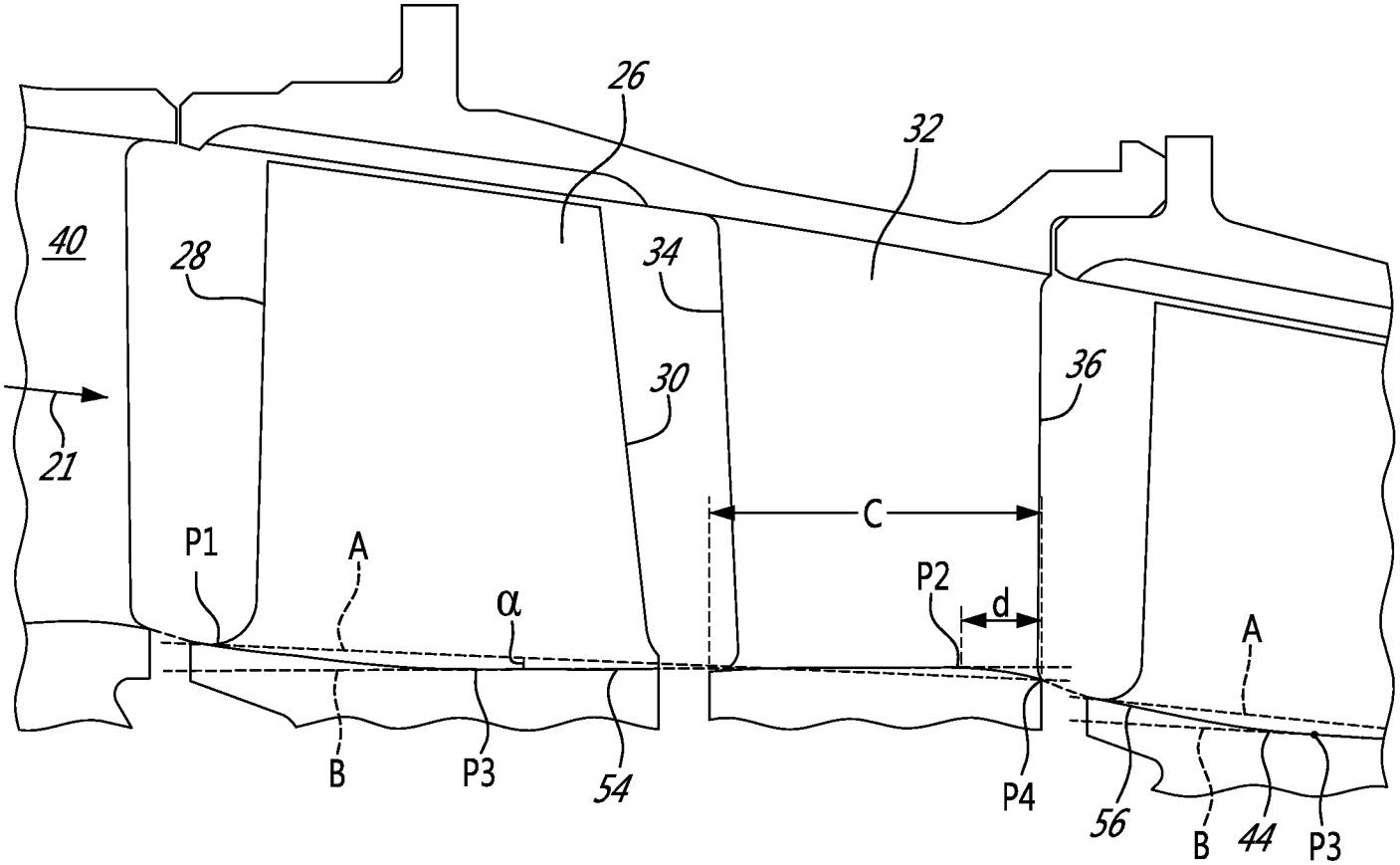
FIG. 4 is a schematic cross-sectional view of a portion of a multi-stage axial flow compressor in accordance with a particular embodiment.

Referring to FIG. 4, a portion of a compressor in accordance with a particular embodiment is shown. In this embodiment, the inner wall 44 is defined by the aligned platforms of the blades 26 and vanes 32, and by an imaginary line connecting adjacent platforms. The step portion 54 extends from point P3 on the inner wall 44 radially aligned with the maximum thickness of the airfoil portion of the rotor blades 26 to point P2 located a distance d upstream of the trailing edge 36 of the stator vane 32. In a particular embodiment, d is from 0 to 20% of the axial chord length C of the vane 32 along the inner wall 44. The orientation of the step portion 54 is illustrated by step line B extending between points P3 and P2. In the embodiment shown, the shape of the inner wall 44 between points P3 and P2 closely follows or correspond to step line B, i.e. the step portion 54 is straight.

A reference line A is defined as extending from point P1 at the intersection of the leading edge 28 of the rotor blade 26 with the inner wall 44 to point P4 at the intersection of the trailing edge 36 of the stator vanes 32 with the inner wall 44. The reference line A thus extends across the compressor stage. In a particular embodiment, the step line B extends at an angle α from 1° to 5° with respect to the reference line A. The step line B slopes more radially outwardly than the reference line A. The step line B may extend parallel to the central axis 11, or may have a positive or negative slope with respect to the axial direction.

The transition portion 56 is defined as a smooth, tangent blend between the step lines B of adjacent step portions 54. The slope of the transition portion thus depends on the distance between the points P2 and P3 of the adjacent step portions 54.

Figure 5:
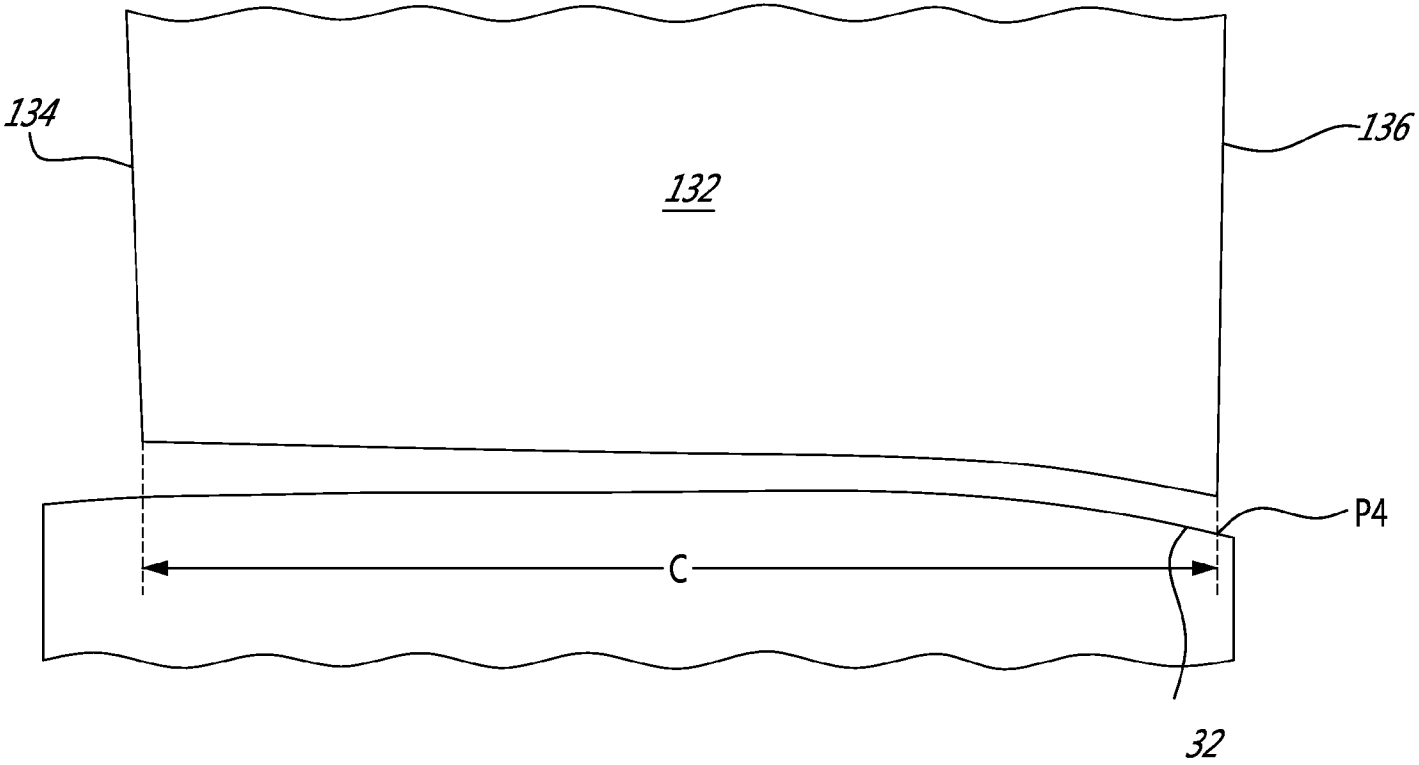
FIG. 5 is a schematic cross-sectional view of part of a vane according to another embodiment.

FIG. 5 illustrates a particular embodiment where the stator vane 132 has a cantilevered tip, such that the tip of the vane 132 is spaced apart from the inner wall 44. The axial chord length C is thus defined between the intersections between tangent lines from the leading and trailing edges 134, 136 and the inner wall 44, and point P4 is defined at the intersection of the tangent to the trailing edge 136 with the inner wall 44.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A multi-stage axial compressor comprising:

a flow path having a plurality of compressor stages each including a rotor and a stator downstream of the rotor with respect to a flow direction of the flow path, the flow path defined between annular inner and outer walls converging from an upstream inlet end to a downstream outlet end of the compressor, the inner and outer walls having a smaller radius at the outlet end than at the inlet end;

wherein the inner wall is stepped from the inlet end to the outlet end to define a step portion for each of the stages, each step portion extending across at least a majority of an axial length of the stage, and the inner wall has a transition portion shaped as a smooth curve between adjacent step portions, each transition portion having a steeper axial slope than that of the adjacent step portions, each transition portion having a smaller radius at a downstream one of the adjacent step portions than at an upstream one of the adjacent step portions.

2. The multi-stage axial compressor as defined in claim 1, wherein a reference line is defined for each stage extending from an intersection of a leading edge of a blade of the rotor with the inner wall to an intersection of a trailing edge of a vane of the stator with the inner wall, and each step portion forms an angle of from 1° to 5° with the reference line of the stage.

3. The multi-stage axial compressor as defined in claim 1, wherein each step portion includes a point on the inner wall radially aligned with a maximum thickness of an airfoil portion of a blade of the rotor.

4. The multi-stage axial compressor as defined in claim 1, wherein each step portion begins at or downstream of an intersection of a leading edge of a blade of the rotor with the inner wall.

5. The multi-stage axial compressor as defined in claim 1, wherein each step portion ends from 0% to 20% of an axial chord length of a vane of the stator along the inner wall upstream of an intersection of a trailing edge of the vane with the inner wall.

6. The multi-stage axial compressor as defined in claim 1, wherein each step portion has an upstream end radially outward of a downstream end of the step portion.

7. The multi-stage axial compressor as defined in claim 1, wherein each step extends parallel to a central axis of the compressor.

8. The multi-stage axial compressor as defined in claim 7, wherein the slope of each step portion is constant.

9. The multi-stage axial compressor as defined in claim 1, wherein each step portion defines a step line along the inner wall, and each transition portion is defined as a smooth tangent blend between the step lines of the adjacent step portions.

10. A multi-stage axial compressor comprising:

a flow path having a plurality of compressor stages each including a rotor and a stator downstream of the rotor with respect to a flow direction of the flow path, the flow path defined between annular inner and outer walls converging from an upstream inlet end to a downstream outlet end of the compressor, the inner and outer walls having a smaller radius at the outlet end than at the inlet end;

wherein the inner wall is stepped from the inlet end to the outlet end to define a step portion for each of the stages, each step portion including a point on the inner wall radially aligned with a maximum thickness of an airfoil portion of a blade of the rotor of the stage and a point on the inner wall radially aligned with a maximum thickness of an airfoil portion of a vane of the stator of the stage, and the inner wall has a transition portion shaped as a smooth curve and connecting each adjacent ones of the step portions, each transition portion converging radially inwardly from an upstream one of the adjacent step portions to a downstream one of the adjacent step portions, each transition portion having a steeper slope than that of the adjacent step portions.

11. The multi-stage axial compressor as defined in claim 10, wherein a reference line is defined for each stage extending from an intersection of a leading edge of a blade of the rotor with the inner wall to an intersection of a trailing edge of a vane of the stator with the inner wall, and each step portion forms an angle of from 1° to 5° with the reference line of the stage.

12. The multi-stage axial compressor as defined in claim 10, wherein each step portion begins at or downstream of an intersection of a leading edge of a blade of the rotor with the inner wall.

13. The multi-stage axial compressor as defined in claim 10, wherein each step portion ends from 0% to 20% of an axial chord length of a vane of the stator along the inner wall upstream of an intersection of a trailing edge of the vane with the inner wall.

14. The multi-stage axial compressor as defined in claim 10, wherein each step portion has an upstream end radially outward of a downstream end of the step portion.

15. The multi-stage axial compressor as defined in claim 10, wherein each step extends parallel to a central axis of the compressor.

16. The multi-stage axial compressor as defined in claim 10, wherein the slope of each step portion is constant.

17. The multi-stage axial compressor as defined in claim 10, wherein each step portion defines a step line along the inner wall, and each transition portion is defined as a smooth tangent blend between the step lines of the adjacent step portions.

18. A method of directing flow through an axial flow compressor having multiple stages, the method comprising:

providing a plurality of successive compressor stages each including a stator and a rotor extending across a flow path, the stator located downstream of the rotor with respect to a direction of the flow;

for each of the compressor stages, directing the flow along a radially inner wall defining the flow path through a portion of the flow path including at least a majority of an axial length of the stage in a first direction having a first slope with respect to an axial direction of the compressor; and between adjacent ones of the stages, directing the flow along the radially inner wall in a second direction angled toward a central axis of the compressor with a second slope greater than each first slope and defining a smooth curve.

19. The method as defined in claim 18, wherein directing the flow in the first direction comprises accelerating the flow.

20. The method as defined in claim 18, wherein directing the flow in the first direction and in the second direction comprises limiting flow separation with respect to the radially inner wall.

21. The method as defined in claim 18, wherein directing the transition portion is aerodynamically configured to reduce an adverse static pressure gradient between the stages.

* * * * *